United States Patent [19]

Izuta

[11] Patent Number: 4,556,042

[45] Date of Patent: Dec. 3, 1985

[54] STABILIZER FOR ARCHERY BOWS

[75] Inventor: Tadao Izuta, Shizuoka, Japan

[73] Assignee: Nippon Gakki Seizo Kabushiki Kaisha, Japan

[21] Appl. No.: 460,848

[22] Filed: Jan. 25, 1983

[30] Foreign Application Priority Data

Jan. 29, 1982 [JP] Japan ..... 57-11087

[51] Int. Cl.[4] ..... F41B 5/00

[52] U.S. Cl. ..... 124/89; 124/24 R

[58] Field of Search ..... 124/89, 23 R, 24 R, 124/88, 86

[56] References Cited

U.S. PATENT DOCUMENTS 3,342,172 9/1967 Sanders ..... 124/23 R
3,757,761 9/1973 Izuta ..... 124/23 R
4,054,121 10/1977 Hoyt ..... 124/89
4,169,454 10/1979 Jones ..... 124/23 R

*Primary Examiner*—Richard J. Apley
*Assistant Examiner*—William R. Browne
*Attorney, Agent, or Firm*—Lerner, David, Littenberg, Krumholz & Mentlik

[57] ABSTRACT

A stabilizer to be attached to the handle raiser of an archery bow is disclosed. The stabilizer includes a pair of laterally extending arms constructed and arranged to be flexible in the shooting direction. Flexing of the arms is mechanically restricted in the shooting direction by the use of a rigid backing overlying a portion of each arm. By mechanically restricting the flexing of the arms, the inertia created is maximized for pushing the archery bow towards the target at release of an arrow.

6 Claims, 4 Drawing Figures

STABILIZER FOR ARCHERY BOWS

BACKGROUND OF THE INVENTION

The present invention relates to an improved stabilizer for archery bows, and more particularly relates to an improved construction of a stabilizer of a type to be attached to the handle raiser of an archery bow.

It is well known that an arrow in general performs at the moment of release an initial behavior called "archer's paradox". More specifically, a nocked arrow is strongly pushed by a string during drawing and the point of the arrow is strongly pressed against the wall of the sight window of the handle raiser of the bow at release of the arrow. As a consequence, the arrow flexes while assuming a shape convex to the side wall of the handle raiser and, as a reaction of this first flexing, next flexes while assuming a shape concave to the side wall of the handle raiser at separation from the bow. This alternate flexing of the arrow repeats even after separation from the bow and, as a consequence, the arrow meanders during its flight towards the target.

As is clear from this initial behaviour, the point of the arrow passes by the handle raiser whilst strongly pressing the arrow against the body of the bow. It is required for the main body of the archery bow to have a subtle reaction to such an initial behavior of the arrow at release. Ill reaction of the main body tends to cause unstable flight of the arrow which results in low rate of hit.

Further, it generally happens with archery bows of the above-described type that the bow as a whole moves in the shooting direction at release of the arrow due to inertia of the limbs, and this movement of the bow tends to cause accidental falling of the arrow from the bow. In order to avoid such a trouble, it is employed to bind the wrist of the player to the main body of the bow by a suitable band. It is also employed to use a stabilizer made up of a pair of rigid arms which are provided with masses at their distal ends. The stabilizer is attached to the handle raiser of the bow so that it extends laterally in a direction normal to the shooting direction, thereby limiting the above-described movement of the main body of the bow at release of the arrow.

In the case of such a conventional stabilizer, however, presence of the stabilizer wields ill influence on the initial behaviour of the arrow and its generation of impulsive vibrations in random directions is liable to disturb stable flight of the arrow.

SUMMARY OF THE INVENTION

It is the object of the present invention to remove the above-described disadvantage of the conventional stabilizer which is attached to the handle raiser of an archery bow.

In accordance with the basic aspect of the present invention, a stabilizer is made up of a pair of laterally extending arms flexible in the shooting direction and a rigid backing attached to the target side surface of the arms.

DESCRIPTION OF THE PREFERRED EMBODIMENTS

Figure 1:
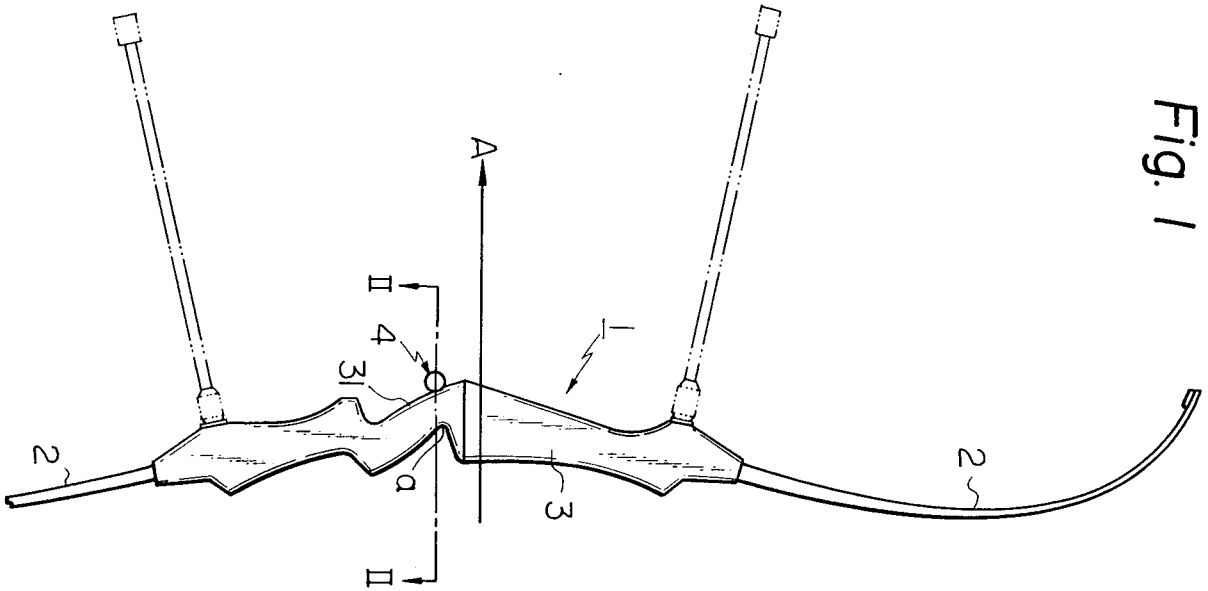
FIG. 1 is a side view, partly omitted, of an archery bow provided with one embodiment of the stabilizer in accordance with the present invention.

In FIG. 1, the main body 1 of an archery bow is made up of a handle raiser 3 and a pair of limbs 2 attached to the distal ends of the handle raiser 3. A stabilizer 4 in accordance with the present invention is mounted to the target side surface 31 of the handle raiser 3 by means of a set screw 5 at a position slightly below the pressure point "a".

Figure 2:
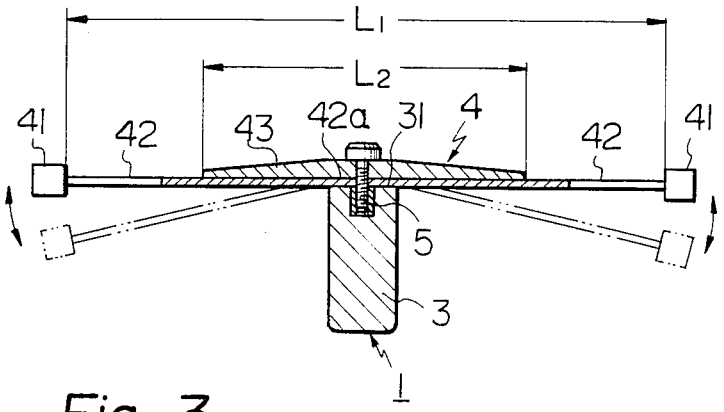
FIG. 2 is a section taken along a line II—II in FIG. 1.

As shown in FIG. 2, the stabilizer 4 is made up of a pair of arms 42 which are made of flexible materials such as leaf springs, and provided at their distal ends with masses 41. From their proximal ends 42*a*, the arms 42 extend symmetrically and laterally in a direction substantially normal to the shooting direction A. The arms 42 are centrally accompanied on their target side surfaces with a rigid backing 43 whose length $L_2$ is smaller than the entire length $L_1$ of the stabilizer 4 so that the arms 42 are flexible in the shooting direction A.

In operation, as the bow tends to move in the shooting direction at release of an arrow due to the inertia of the limbs, the arms first tend to flex towards the target side. However, this flexing is restricted due to presence of the rigid backing 43 on the target side of the arms 42. As a reaction, the arms 42 next flex greatly towards the face side of the bow. On reversal from this flexing, the inertia of the arms 42, which has been maximized by the great flexing, urges the bow to move in the shooting direction thereby greatly stabilizing flight of the arrow right towards the target.

Thus in the case of this embodiment, the rigid backing 43 provide stable, firm reaction to the arms by its rigid nature.

Figure 3:
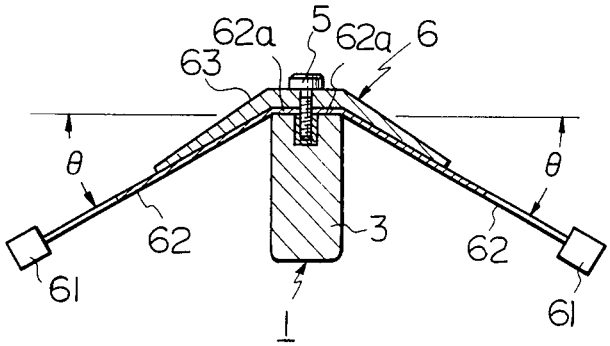
FIG. 3 is a transverse sectional view of the handle raiser of an archery bow provided with another embodiment of the stabilizer in accordance with the present invention.

Another embodiment of the stabilizer in accordance with the present invention is shown in FIG. 3, in which the stabilizer 6 is made up of a pair of arms 62 which are also made of flexible materials such as leaf spring, and provided at their distal ends with masses 61. From their proximal ends 62*a* which are almost parallel to the string side surface 31 of the handle raiser 6, the arms 62 extends symmetrically and laterally towards the face side of the bow with an angle of bias $\theta$. The arms 62 are centrally accompanied on their target side surface with a rigid backing 63 which is shorter than the stabilizer so that the arms 62 are flexible in the shooting direction. In this case, the backing 63 is shaped so as to follow the bias of the arms 62 towards the face side of the bow.

Like the first embodiment, presence of the backing 63 maximizes inertia of the flexible arms 62 and, as a consequence, well promotes movement of the bow towards the target at release of an arrow.

The angle of bias $\theta$ should preferably be in a range from 30 to 60 degrees. By properly selecting the value of the angle of bias $\theta$, the center of gravity of the bow and moment about the center of gravity can be adjusted so as to conform to archer's personal conditions.

Figure 4:
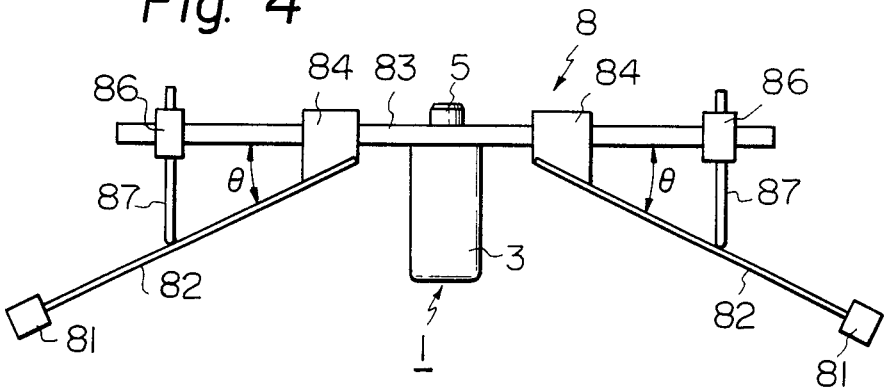
FIG. 4 is a top view, partly omitted, of the handle raiser of an archery bow provided with the other embodiment of the stabilizer in accordance with the present invention.

The other embodiment of the stabilizer in accordance with the present invention is shown in FIG. 4, in which the stabilizer 8 includes a laterally and symmetrically extending guide bar 83 fixed to the target side of the handle raiser 3 by means of a set screw 5. A pair of first sliders 84 are mounted to the guide bar 83 slidably in the longitudinal direction of the latter. Each first slider 84 fixedly carries a flexible arm 82 which extends laterally towards the face side of the bow with an angle of bias $\theta$ and provided at its distal end with a mass 81. On the laterally outer side of each first slider 84, a second slider 86 is slidably mounted to the guide bar 83 and carries an adjuster pin 87 which is shiftable in the shooting direction with respect to the second slider 86. The face side point of the ajuster pin 87 abuts the target side of the associated flexible arm 82.

The value of the angle of bias $\theta$ can be freely and subtlely adjusted by changing the position of the first and second sliders 84 and 86 on the guide bar 83 and shifting the adjuster pin 87 with respect to the second slider 86. Depending on archer's personal condition, such change in position of the sliders and shifting of the adjuster pin can be properly combined. In the case of the second embodiment, adjustment in value of the angle of bias $\theta$ requires replacement of the rigid backing 63. In the third embodiment, however, adjustment requires simple change in position of the components only.

In an alternative of the embodiment shown in FIG. 4, the arms 82 may be mounted to the first slider 84 via hinge joints for easier adjustment of the angle of bias.

I claim:

1. An improved stabilizer for an archery bow having a handle raiser, said stabilizer comprising a pair of flexible arms attached at their proximal ends to the target side surface of a handle raiser of an archery bow and extending symmetrically and laterally with respect to said handle raiser from said proximal ends in an arrangement flexible in the shooting direction, said arms accompanied at their distal ends with masses, and a rigid backing centrally attached to the target side surface of said flexible arms overlying said proximal ends, said rigid backing extending laterally from said handle raiser and overlying a portion of the target side surface of said flexible arms for restricting the flexing of said arms in a direction towards said rigid backing.

2. The stabilizer of claim 1 wherein said pair of arms are arranged along a common axis.

3. The stabilizer of claim 2 wherein said common axis is arranged normal to the longitudinal axis of a handle raiser of an archery bow.

4. The stabilizer of claim 1 wherein said pair of arms have a first portion lying along a common axis and a second portion arranged at an angle to said common axis.

5. The stabilizer of claim 4 wherein said second portion of said pair of arms forms an angle in the range of from 30 to 60 degrees with said common axis.

6. The stabilizer of claim 1 wherein the length of said rigid backing is less than the combined length of said flexible arms.

* * * * *